US005377366A

United States Patent [19]

Boyd et al.

[11] Patent Number: 5,377,366

[45] Date of Patent: Jan. 3, 1995

[54] FLUID OPERATED BATHTUB CHAIR

[76] Inventors: Kenneth Boyd, 917 Gretna La.; Gussie B. Boyd, 10738 Toulen Dr., both of Cincinnati, Ohio 45240

[21] Appl. No.: 66,592

[22] Filed: May 24, 1993

[51] Int. Cl.[6] ..... A47K 3/12

[52] U.S. Cl. ..... 4/561.1; 4/563.1; 4/541.1

[58] Field of Search ..... 4/560.1, 561.1, 562.1, 4/563.1, 564.1, 565.1, 566.1, 559, 541.1, 541.2, 541.3, 541.4, 541.5, 579

[56] References Cited

U.S. PATENT DOCUMENTS

| | | | |
|---|---|---|---|
| 2,582,586 | 1/1952 | Dorr | 4/562.1 |
| 2,725,578 | 12/1955 | Keller | 4/565.1 |
| 3,419,044 | 12/1968 | Daniels et al. | 4/563.1 |
| 3,545,013 | 12/1970 | Discoe | 4/563.1 |
| 3,950,793 | 4/1976 | Adams | 4/559 |
| 4,013,316 | 3/1977 | Cropper | 4/564.1 |
| 4,417,568 | 11/1983 | Nozawa et al. | 4/541.5 |
| 4,453,279 | 6/1984 | Logsdon | 4/559 |
| 4,574,407 | 3/1986 | Didia | 4/559 |
| 4,986,781 | 1/1991 | Smith | 4/541.3 |
| 5,150,482 | 9/1992 | Shapiro | 4/563.1 |
| 5,226,183 | 7/1993 | Clark | 4/560.1 |

*Primary Examiner*—Henry J. Recla
*Assistant Examiner*—Charles R. Eloshway

[57] ABSTRACT

A new and improved bathtub chair includes a fluid operated chair assembly. A fluid pressure generating assembly, such as an air pump, generates fluid pressure for operating the fluid operated chair assembly. A fluid pressure valve assembly, connected between the fluid operated chair assembly and the fluid pressure generating assembly, controls fluid pressure applied to the fluid operated chair assembly. The fluid operated chair assembly includes a seat member. A plurality of extensible legs support the seat member. A fluid pressure responsive lifting assembly, such as a bellows, located under the seat member, raises and lowers the seat member. The bellows is powered by air pressure from the air pump through the fluid pressure valve assembly. The bellows is supported by bellows support members connected to the extensible legs of the chair assembly. The fluid operated chair assembly includes a rotation assembly which permits rotation of the seat member with respect to a bathtub. This feature facilitates a person sitting upon or being lifted from the seat member by rotating the seat member ninety degrees from the seat member position that may be employed when the person may be in the bathtub. Once the person is on the seat member, the seat member can be rotated ninety degrees in the opposite direction to facilitate the person sitting on the seat member while in the bathtub. A bubble massage assembly may be included which receives air pressure from the air pump for providing bubbles in water in the bathtub.

9 Claims, 4 Drawing Sheets

FLUID OPERATED BATHTUB CHAIR

BACKGROUND OF THE INVENTION

1. Field of the Invention

The present invention relates generally to chairs and lifts for persons having limited use of their legs, and more particularly, to a chairs and lifts especially adapted for lowering a seated person into a bathtub.

2. Description of the Prior Art

People who have limited use of their legs often have problems getting into and out of a bathtub. There are a number of devices disclosed in the prior art which propose solutions to this problem. For example, U.S. Pat. No. 4,034,426 discloses a bathtub lift chair apparatus which fits entirely into the bathtub. A crank is provided for each hand, and the chair is lifted by hand cranking. This device has several disadvantages. A person having limited use of one's legs may also have limited strength in one's hands and arms. Thus, hand cranking may be a difficult, if not impossible task. In this respect, it would be desirable if a bathtub chair device were provided that did not require hand cranking to adjust the chair.

Also, with the device disclosed in U.S. Pat. No. 4,034,426, a number of moving metal parts are directly exposed to soapy water in a bathtub. Such conditions promote rust and corrosion of the metal parts. In this respect, it would be desirable if a bathtub chair device were provided that did not expose moving metal parts to soapy water in a bathtub.

Also, with the device disclosed in U.S. Pat. No. 4,034,426, a person must climb into the bathtub before sitting in the seat. This task may be difficult for a person with limited use of the legs. In this respect, it would be desirable if a bathtub chair device were provided which permitted the following sequence of steps for a person: to sit in the chair when outside the bathtub, to be swung into the bathtub, to be lowered into tile bathtub for bathing, to be raised up from the bathtub, and to be swung out of the bathtub when finished.

Other bathtub lift chairs ate disclosed in U.S. Pat. Nos. 4,091,478 and 4,928,330 in which a columnar screw jack is used to raise and lower the lift chair. The columnar screw jack is a large, bulky structure which occupies quite a bit of space outside the bathtub. Because some bathrooms have limited space, it would be desirable if a bathtub chair device were provided that occupied little space outside the bathtub.

Another problem associated with the devices in U.S. Pat. Nos. 4,091,478 and 4,928,330 is that the respective columnar screw jacks are fastened to the respective floors on which the jacks are employed. Fastening the jack to the floor in undesirable for a number of reasons. By fastening the screw jack to the floor, the bathtub chair device cannot readily be moved from one bathtub to another. In this respect, it would be desirable if a bathtub chair device were provided which could readily be moved from one bathtub to another. Also, fastening the screw jack to the floor does damage to the floor. This may be especially undesirable because it may destroy the beauty and the water retaining abilities of the floor. In this respect, it would be desirable if a bathtub chair device were provided which does not damage the floor, thereby not destroying the beauty and the water retaining abilities of the floor.

Another problem associated with the devices in U.S. Pat. Nos. 4,091,478 and 4,928,330 is that the respective columnar screw jacks are hand operated. Hand operation is time consuming and often very fatiguing. In this respect, it would be desirable if a bathtub chair device were provided that utilized electric power for the lifting operation.

U.S. Pat. No. 4,453,766 discloses an electrically powered lift chair for a disabled person that employs an electric motor attached to the lifting mechanism of the chair. Because of this arrangement, the chair cannot be used in the bathtub because of the dangerous incompatibility of electricity and water. In this respect, it would be desirable if a bathtub chair device were provided that utilized electric power for the lifting operation without presenting the dangerous incompatibility of electricity and water.

Often when a person is in a bathtub, one would like to undergo a bubble massage. With conventional bathtub chair devices, a separate and distinct bubble massage unit would have to be used. Such a separate unit would take up quite a bit of extra space and complicate the equipment at the tub considerably, In this respect, it would be desirable if a bathtub chair device were provided that also included provisions for providing a bubble massage.

Often when a person is bathing, one wishes to perform certain personal grooming tasks on one's hair and face. In this respect, it would be desirable if a bathtub chair device were provided with an attachment that facilitated carrying out personal grooming tasks.

Thus, while the foregoing body of prior art indicates it to be well known to use bathtub chair devices, the prior art described above does not teach or suggest a bathtub chair device which has the following combination of desirable features: (1) does not require hand cranking to adjust the chair; (2) does not expose moving metal parts to soapy water in a bathtub; (3) permits the following sequence of steps to take place for a person—to sit in the chair when outside the bathtub, to be swung into the bathtub, to be lowered into the bathtub for bathing, to be raised up from the bathtub, and to be swung out of the bathtub when finished; (4) occupies little space outside the bathtub; (5) can readily be moved from one bathtub to another; (6) does not damage the floor, thereby not destroying the beauty and the water retaining abilities of the floor; (7) utilizes electric power for the lifting operation; (8) utilizes electric power for the lifting operation without presenting the dangerous incompatibility of electricity and water; (9) includes provisions for providing a bubble massage; and (10) provides an attachment that facilitates carrying out personal grooming tasks. The foregoing desired characteristics are provided by the unique fluid operated bathtub chair of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved bathtub chair which includes a fluid operated chair assembly. A fluid pressure generating assembly generates fluid pressure for operating the fluid operated chair assembly. A fluid pressure valve assembly, connected between the fluid operated chair assembly and the fluid pressure generating assembly, controls fluid pressure applied to the fluid operated chair assembly. The fluid operated chair assembly operates with pneumatic or air pressure, and the fluid pressure generating assembly generates pneumatic pressure.

The fluid operated chair assembly includes a seat member. A plurality of extensible legs support the seat member. A fluid pressure responsive lifting assembly, located under the seat member, raises and lowers the seat member. The fluid pressure responsive lifting assembly is powered by the fluid pressure generating assembly through the fluid pressure valve assembly. The fluid pressure responsive lifting assembly may include bellows support members connected to the extensible legs. A bellows member, supported by the bellows support members, may be located under the seat member, such that when fluid pressure may be applied to the bellows member, the bellows member lifts the seat member and a person sitting on the seat member. Conversely, when fluid pressure may be released from the bellows member, the seat member may be lowered.

The fluid operated chair assembly may include a rotation assembly which permits rotation of the seat member with respect to a bathtub. This features facilitates a person sitting upon or being lifted from the seat member by rotating the seat member ninety degrees from the seat member position that may be employed when the person may be in the bathtub. Once the person in on the seat member, the seat member can be rotated ninety degrees in the opposite direction to facilitate the person sitting on the seat member while in the bathtub.

The rotation assembly may include a top rotation member connected to the seat member. A bottom rotation member may be connected to the extensible legs, and rotatable elements are located between the bottom rotation member and the top rotation member, such that rotation of the top rotation member may be permitted with respect to the bottom rotation member which remains stationary. A handle may be connected to the top rotation member and controls rotation of the top rotation member and the seat member with respect to the bottom rotation member and the legs which remain stationary.

The seat member may include a top flexible portion, a bottom rigid portion, and a peripheral spacer member located between the top flexible portion and the bottom rigid portion, such that the top flexible portion may be permitted to support a person when the person may be sitting on the top flexible portion without central portions of the top flexible portion contacting the rigid bottom rigid portion.

The fluid pressure valve assembly may include a first selectable fluid pressure circuit for directing fluid pressure from the fluid pressure generating assembly to the fluid operated chair assembly for raising the seat member, and a second selectable fluid pressure circuit for permitting fluid pressure to be released from the fluid operated chair assembly for lowering the seat member. The fluid pressure valve assembly may include a connecting assembly for connecting the fluid pressure valve assembly to a top of a sidewall of the bathtub.

A bubble massage assembly receives fluid pressure from the fluid pressure generating assembly for providing bubbles of fluid in water in the bathtub. The bubble massage assembly may include a housing member which may include a plurality bubble outlets. The bubble massage assembly may be connected to the fluid pressure valve assembly for receiving fluid pressure from the fluid pressure valve assembly. In this respect, the fluid pressure valve assembly may include a first selectable fluid pressure circuit for directing fluid pressure from the fluid pressure generating assembly to the fluid operated chair assembly for raising the seat member, a second selectable fluid pressure circuit for permitting fluid pressure to be released from the fluid operated chair assembly for lowering the seat member, and a third selectable fluid pressure circuit for permitting fluid pressure to be directed to the bubble massage assembly.

A personal grooming attachment assembly may be attached to the fluid operated chair assembly. The personal grooming attachment assembly may include a leg portion which may be attachable to the fluid operated chair assembly. A tray portion may be connected to and may be supported by the leg portion. The personal grooming attachment assembly may be used for supporting personal grooming items. Tile tray portion may include a plurality of shallow wells for holding items. A mirror assembly may be connected to the tray portion.

The above brief description sets forth rather broadly tile more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved fluid operated bathtub chair which has all of the advantages of the prior art and none of the disadvantages.

It is another object of the present invention to provide a new and improved fluid operated bathtub chair which may be easily and efficiently manufactured and marketed.

It is a further object of the present invention to provide a new and improved fluid operated bathtub chair which is of durable and reliable construction.

An even further object of the present invention is to provide a new and improved fluid operated bathtub chair which is susceptible of a low cost of manufacture with regard to both materials and labor, and which accordingly is then susceptible of low prices of :sale to the consuming public, thereby making such fluid operated bathtub chair available to the buying public.

Still yet a further object of the present invention is to provide a new and improved fluid operated bathtub chair which does not require hand cranking to adjust the chair.

Still another object of the present invention is to provide a new and improved fluid operated bathtub chair that does not expose moving metal parts to soapy water in a bathtub.

Yet another object of the present invention is to provide a new and improved fluid operated bathtub chair which permits the following sequence of steps to take place for a person—to sit in the chair when outside the bathtub, to be swung into the bathtub, to be lowered into the bathtub for bathing, to be raised up from the bathtub, and to be swung out of the bathtub when finished.

Even another object of the present invention is to provide a new and improved fluid operated bathtub chair that occupies little space outside the bathtub.

Still a further object of the present invention is to provide a new and improved fluid operated bathtub chair which can readily be moved from one bathtub to another.

Yet another object of the present invention is to provide a new and improved fluid operated bathtub chair that does not damage the floor, thereby not destroying the beauty and the water retaining abilities of the floor.

Still another object of the present invention is to provide a new and improved fluid operated bathtub chair which utilizes electric power for the lifting operation.

Yet another object of the present invention is to provide a new and improved fluid operated bathtub chair utilizes electric power for the lifting operation without presenting the dangerous incompatibility of electricity and water.

Still yet a further object of the present invention is to provide a new and improved fluid operated bathtub chair which includes provisions for providing a bubble massage.

Still another object of the present invention is to provide a new and improved fluid operated bathtub chair that provides an attachment that facilitates carrying out personal grooming tasks.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
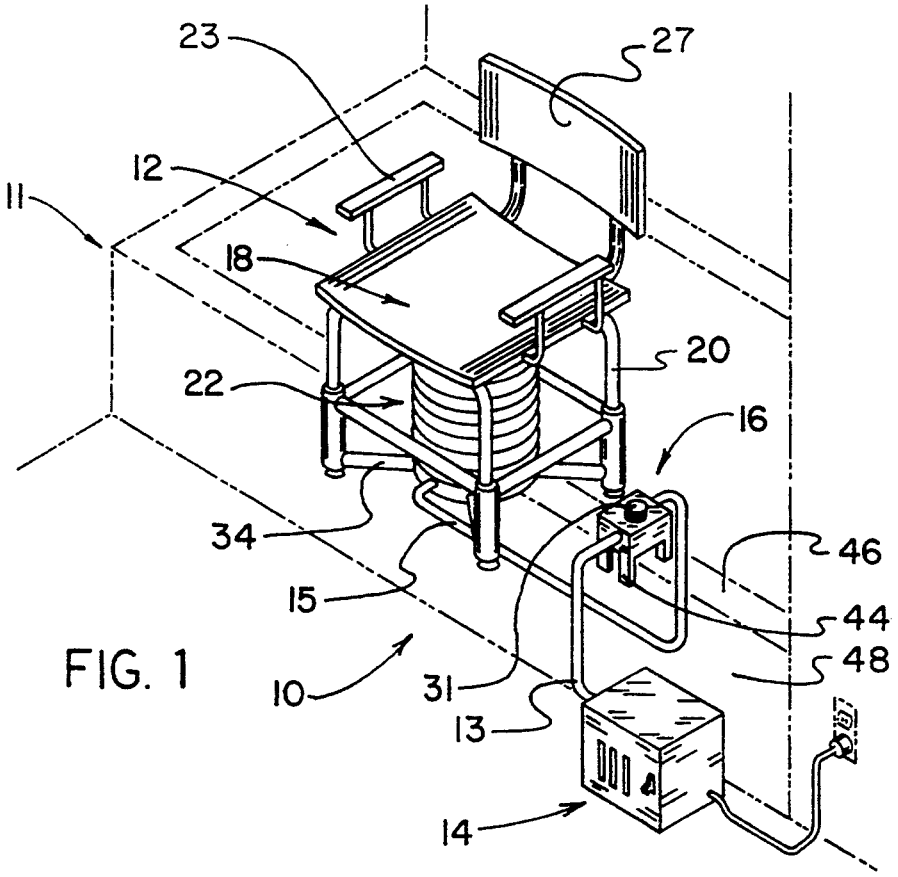
FIG. 1 is a perspective view showing a first preferred embodiment of the fluid operated bathtub chair of the invention with the chair in the bathtub.

With reference to the drawings, a new and improved fluid operated bathtub chair embodying the principles and concepts of the present invention will be described.

Turning initially to FIGS. 1–4, there is shown a first exemplary embodiment of the fluid operated bathtub chair of the invention generally designated by reference numeral 10. In its preferred form, the fluid operated bathtub chair apparatus 10 includes a fluid operated chair assembly 12. A fluid pressure generating assembly 14 generates fluid pressure for operating the fluid operated chair assembly 12. A fluid pressure valve assembly 16, connected between the fluid operated chair assembly 12 and the fluid pressure generating assembly 14, controls fluid pressure applied to the fluid operated chair assembly 12. The fluid operated chair assembly 12 operates with pneumatic or air pressure, and the fluid pressure generating assembly 14 generates pneumatic pressure. The fluid pressure generating assembly 14 is a portable air pump which generates air pressure. The air pump is a conventional air compressor and includes a storage tank, a pressure relief valve, a safety valve, and a check valve. The air pump is electrically operated and plugs into a wall outlet.

The fluid operated chair assembly 12 includes a seat member 18. A plurality of extensible legs 20 support the seat member 18. The extensible legs 20 may be in the form of fluid shock absorbers as shown. A fluid pressure responsive lifting assembly 22, located under the seat member 18, raises and lowers the seat member 18. The fluid pressure responsive lifting assembly 22 is powered by the fluid pressure generating assembly 14 through the fluid pressure valve assembly 16. The fluid pressure responsive lifting assembly 22 includes bellows support members 34 connected to the extensible legs 20. A bellows member 32, supported by the bellows support members 34, is located under the seat member 18, such that when fluid pressure is applied to the bellows member 32, the bellows member 32 lifts the seat member 18 and a person sitting on the seat member 18. Conversely, when fluid pressure is released from the bellows member 32, the seat member 18 is lowered.

Figure 2:
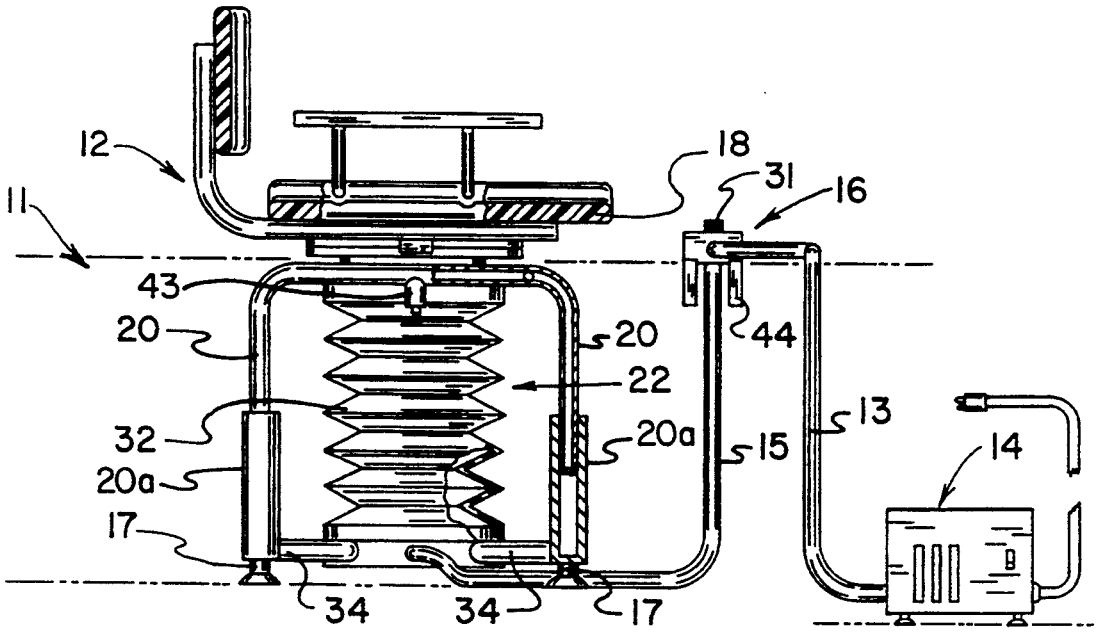
FIG. 2 is a side view of the embodiment of the invention shown in FIG. 1.
Figure 3:
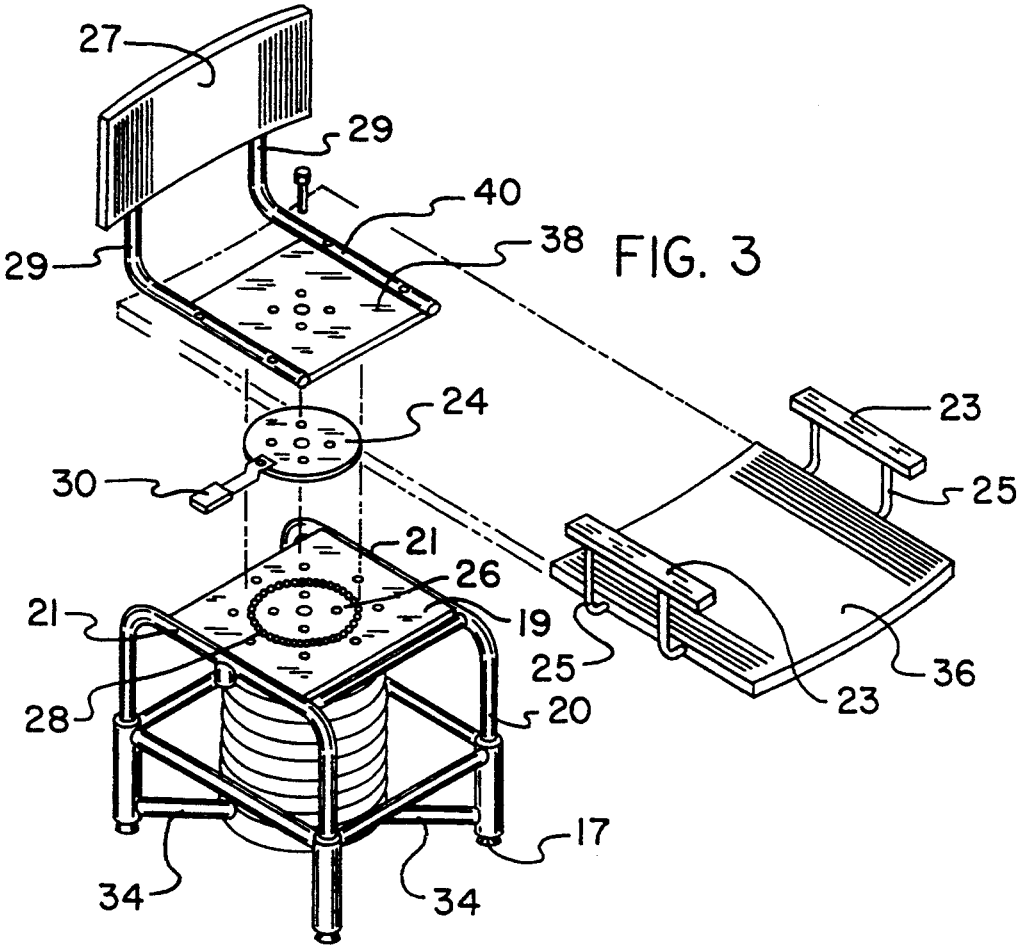
FIG. 3 is an exploded perspective view of the top portion of the chair assembly of the embodiment shown in FIG. 1.
Figure 4:
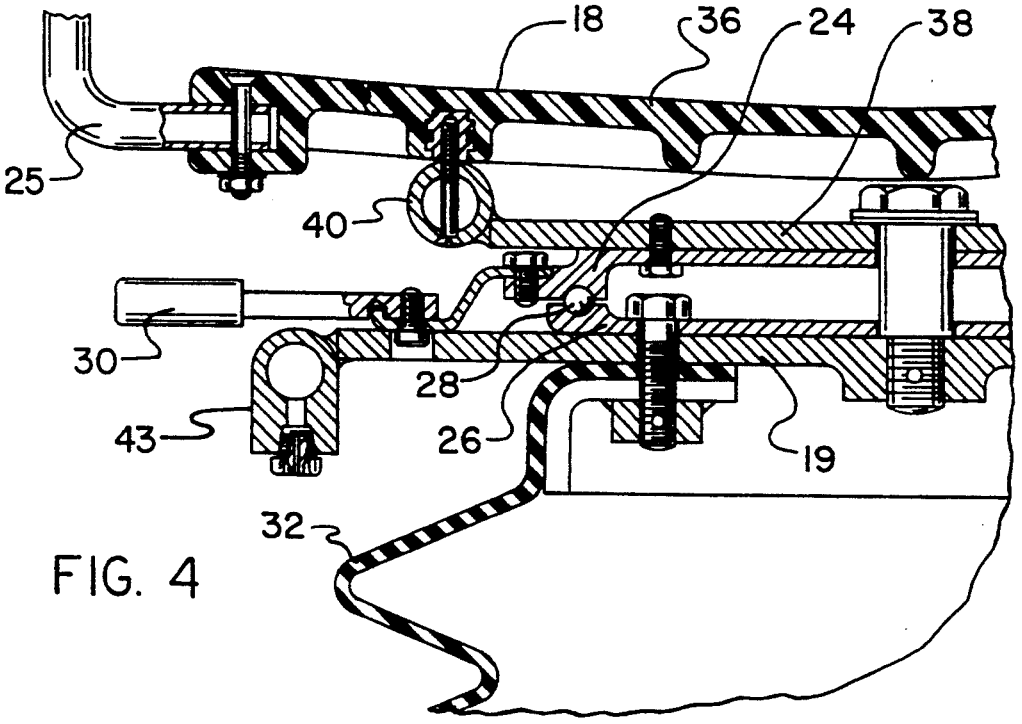
FIG. 4 is an enlarged, partial cross-sectional view of the top portion of the chair assembly shown in FIG. 3 as assembled.

The extensible legs 20, in the form of fluid shock absorbers 20*a*, as shown in FIG. 2, have air chambers 41 which are interconnected through hollow tubing. A common valve 43 controls release of air from the air chambers 41 for reducing shocks as the seat member 18 is raised and lowered.

Suction cups 17 are located at the bottom portions of the extensible legs 20 for providing a good grip between the fluid operated bathtub chair of the invention and the floor of the bathtub 11.

Flexible air hose 13 runs from the fluid pressure generating assembly 14 to the fluid pressure valve assembly 16. Flexible air hose 15 runs from the fluid pressure valve assembly 16 to the bellows 32.

The fluid operated chair assembly 12 includes a rotation assembly which permits rotation of the seat member 18 with respect to a bathtub 11. This feature facilitates a person sitting upon or being lifted from the seat member 18 by rotating the seat member 18 ninety degrees from the seat member position that is employed when the person is in the bathtub 11. Once the person in on the seat member 18, the seat member 18 can be rotated ninety degrees in the opposite direction to facilitate the person sitting on the seat member 18 while in the bathtub 11.

The rotation assembly includes a top rotation member 24 connected to the seat member 18. A bottom rotation member 26 is connected to the extensible legs 20, and rotatable elements 28 (e.g. ball bearings) are located between the bottom rotation member 26 and the top rotation member 24, such that rotation of the top rotation member 24 is permitted with respect to the bottom rotation member 26 which remains stationary. The respective top rotation member 24 and bottom rotation member 26 have channels for receipt of the ball bearings 28. A handle 30 is connected to the top rotation member 24 and controls rotation of the top rotation member 24 and the seat member 18 with respect to the bottom rotation member 26 and the extensible legs 20 which remain stationary. The bottom rotation member 26 is supported by a base plate 19 which is connected to horizontal support members 21 which are supported by the extensible legs 20.

The seat member 18 includes a top flexible portion 36, a bottom rigid portion 38, and two peripheral spacer members 40 located between the top flexible portion 36 and the bottom rigid portion 38, such that the top flexible portion 36 is permitted to support a person when the person is sitting on the top flexible portion 36 without central portions of the top flexible portion 36 contacting the rigid bottom rigid portion 38. Arm rests 23 are connected by arm rest supports 25 to the top flexible portion 36. A back rest 27 is supported by back rest support portions 29 which are connected to peripheral spacer members 40.

The fluid pressure valve assembly 16 includes a first selectable fluid pressure circuit for directing fluid pressure from the fluid pressure generating assembly 14 to the fluid operated chair assembly 12 for raising the seat member 18, and a second selectable fluid pressure circuit for permitting fluid pressure to be released from the fluid operated chair assembly 12 for lowering the seat member 18. A knob 31 is used for selecting the respective air circuits. In addition, the fluid pressure valve assembly 16 includes a connecting assembly 44 for connecting the fluid pressure valve assembly 16 to a top 46 of a sidewall 48 of the bathtub 11.

Figure 5:
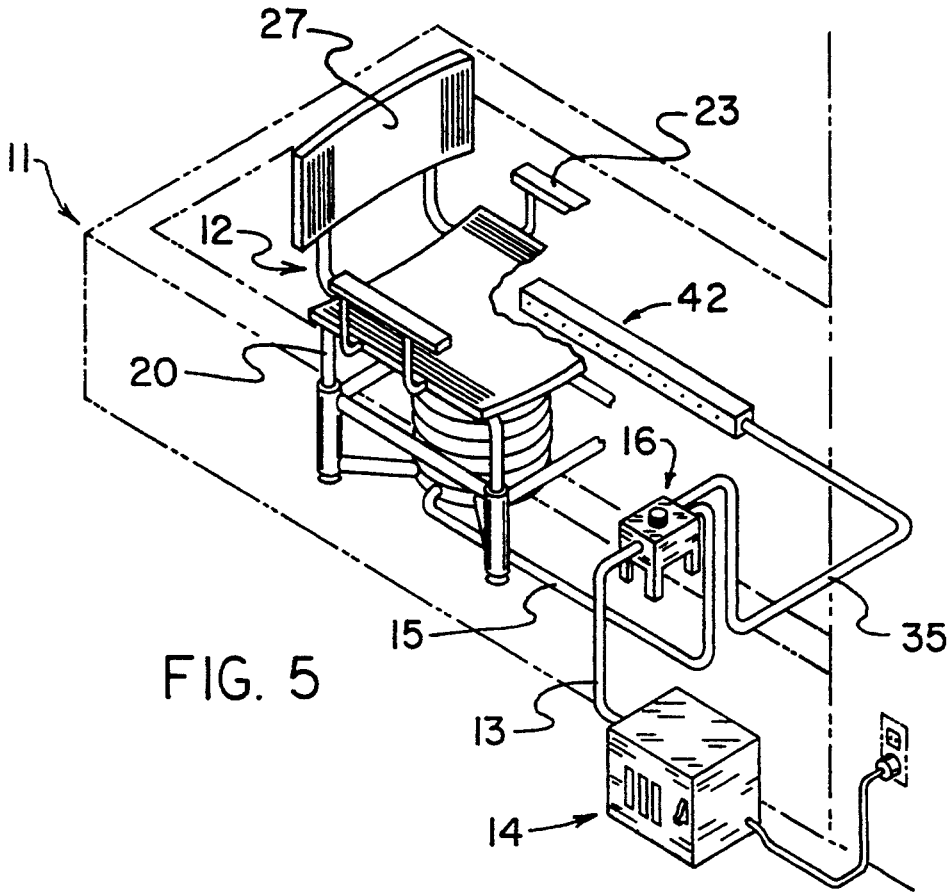
FIG. 5 is a perspective view showing a second preferred embodiment of the fluid operated bathtub chair of the invention which includes bubble massage features.
Figure 6:
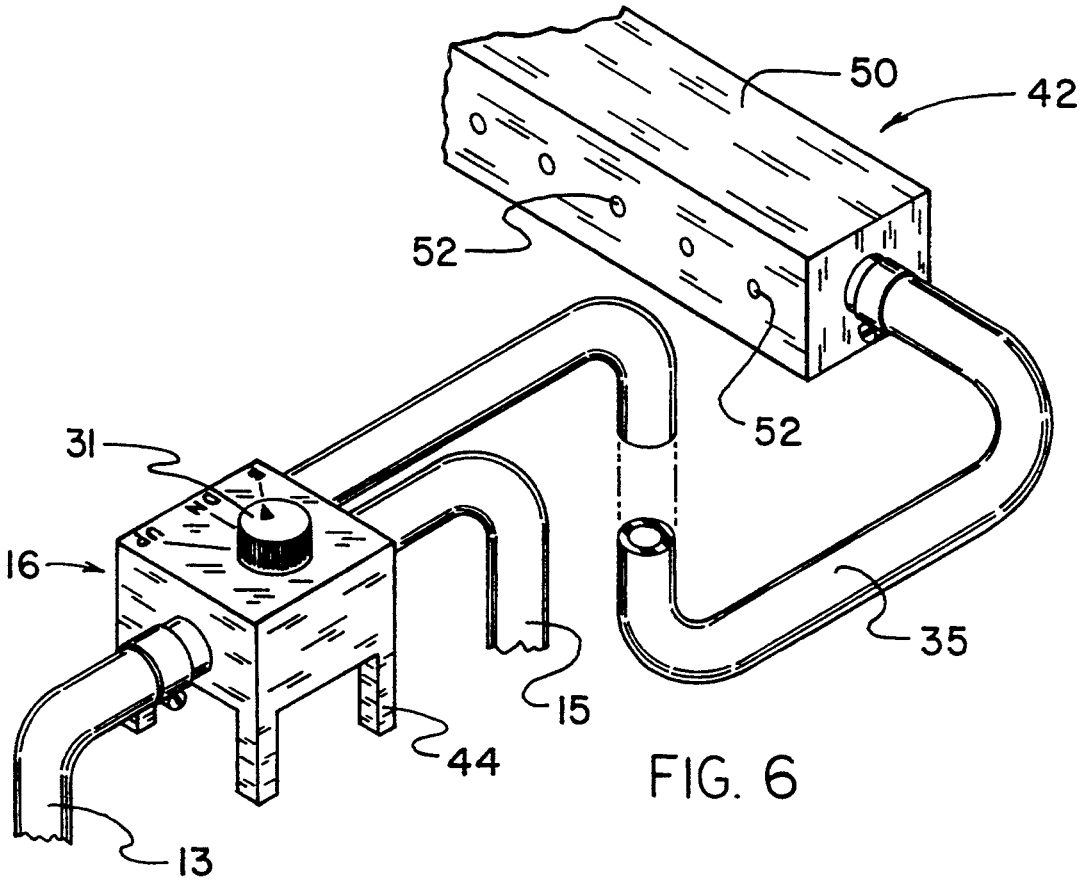
FIG. 6 is an enlarged, partial perspective view of the bubble massage assembly shown in FIG. 5.

Turning to FIGS. 5–6, a second embodiment of the invention is shown. Reference numerals are shown that correspond to like reference numerals that designate like elements shown in the other figures. In addition, a bubble massage assembly 42 receives fluid pressure from the fluid pressure generating assembly 14 by way of fluid pressure valve assembly 16 and air hose 35, for providing bubbles of fluid in water in the bathtub 11. The bubble massage assembly 42 includes a housing member 50 which includes a plurality of bubble outlets 52. The bubble massage assembly 42 is connected to the fluid pressure valve assembly 16 for receiving fluid pressure from the fluid pressure valve assembly 16. In this respect, the fluid pressure valve assembly 16 includes a first selectable fluid pressure circuit for directing fluid pressure from the fluid pressure generating assembly 14 to the fluid operated chair assembly 12 for raising the seat member 18, a second selectable fluid pressure circuit for permitting fluid pressure to be released from the fluid operated chair assembly 12 for lowering the seat member 18, and a third selectable fluid pressure circuit tier permitting fluid pressure to be directed to the bubble massage assembly 42. The knob 31 is used for selecting the respective circuits.

Figure 7:
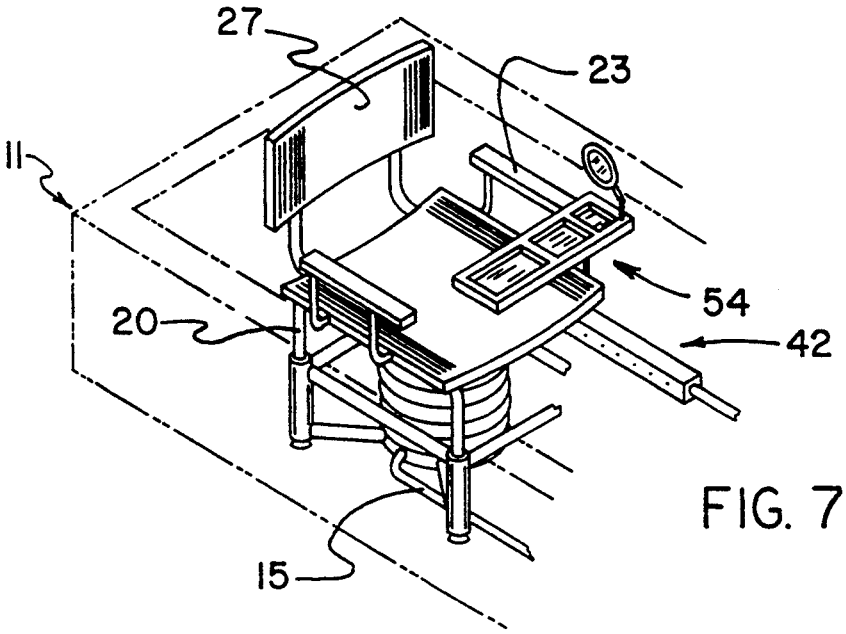
FIG. 7 is a perspective view showing a third preferred embodiment of the fluid operated bathtub chair of the invention which includes an attachment to the chair portion for facilitating personal grooming tasks.
Figure 8:
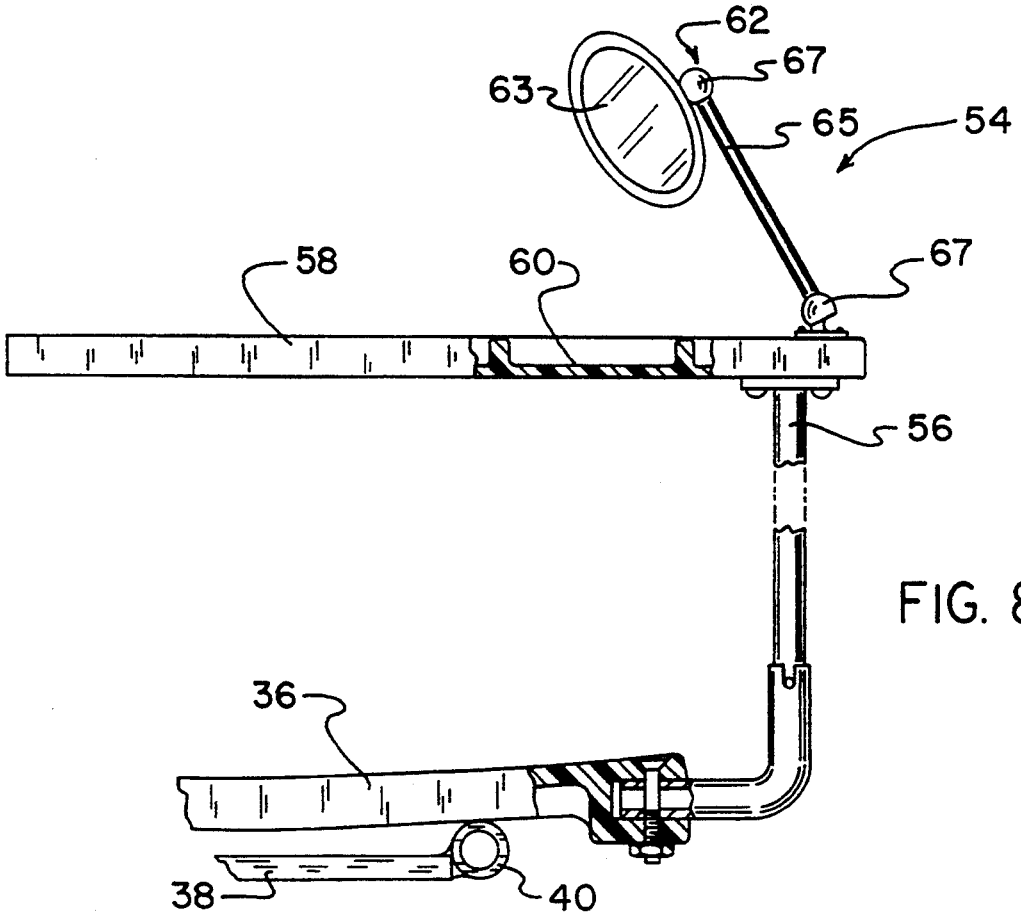
FIG. 8 is an enlarged front view of the personal grooming attachment shown in FIG. 7.

Turning to FIGS. 7–8, a third embodiment of the invention is shown. Reference numerals are shown that correspond to like reference numerals that designate like elements shown in the other figures. In addition, a personal grooming attachment assembly 54 is attached to the fluid operated chair assembly 12. The personal grooming attachment assembly 54 includes a leg portion 56 which is attachable the top flexible portion 36 of the fluid operated chair assembly 12. A tray portion 58 is connected to and is supported by the leg portion 56. The personal grooming attachment assembly 54 is used for supporting personal grooming items. The tray portion 58 includes a plurality of shallow wells 60 for holding items.

A mirror assembly 62 is connected to the tray portion 58. The mirror assembly 62 includes a mirror element 63 and a support rod 65 having two ball-and-socket connectors 67.

The components of the fluid operated bathtub chair apparatus of the invention can be made from inexpensive and durable metal and plastic materials. The extensible legs may also be in the form of hydraulic shock absorbers.

Alternatively, if desired, hydraulic pressure and means for providing hydraulic pressure can be used for raising and lowering the fluid operated chair assembly.

It is apparent from the above that the present invention accomplishes all of the objects set forth by providing a new and improved fluid operated bathtub chair that is low in cost, relatively simple in design and operation, and which may advantageously be used without requiring hand cranking to adjust the chair. With the invention, a fluid operated bathtub chair is provided which does not expose moving metal parts to soapy water in a bathtub. With the invention, a fluid operated bathtub chair is provided which permits the following sequence of steps to take place for a person—to sit in the chair when outside the bathtub, to be swung into the bathtub, to be lowered into the bathtub for bathing, to be raised up from the bathtub, and to be swung out of the bathtub when finished. With the invention, a fluid operated bathtub chair is provided which occupies little space outside the bathtub. With the invention, a fluid operated bathtub chair apparatus is provided which can readily be moved from one bathtub to another. With the invention, a fluid operated bathtub chair apparatus is provided which does not damage the floor, thereby not destroying the beauty and the water retaining abilities of the floor. With the invention, a fluid operated bathtub chair is provided which utilizes electric power for the lifting operation without presenting the dangerous incompatibility of electricity and water. With the invention, a fluid operated bathtub chair is provided which includes provisions for providing a bubble massage. With the invention, a fluid operated bathtub chair apparatus is provided which provides an attachment that facilitates carrying out personal grooming tasks.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A bathtub chair, comprising:

a fluid operated chair assembly having a seat member, a fluid pressure generating assembly for generating fluid pressure for raising and lowering said fluid operated chair assembly, and a fluid pressure valve assembly, connected between said fluid operated chair assembly and said fluid pressure generating assembly, for controlling fluid pressure applied to said fluid operated chair assembly;

and further including a bubble massage assembly, receiving fluid pressure from said fluid pressure generating assembly, for providing bubbles of fluid in water in a bathtub.

2. The apparatus described in claim 1 wherein said bubble massage assembly includes a housing member which includes a plurality of bubble outlets.

3. The apparatus described in claim 1 wherein said bubble massage assembly is connected to said fluid pressure valve assembly for receiving fluid pressure from said fluid pressure valve assembly.

4. The apparatus described in claim 1 wherein said fluid pressure valve assembly includes:

a first selectable fluid pressure circuit for directing fluid pressure from said fluid pressure generating assembly to said fluid operated chair assembly for raising said seat member, a second selectable fluid pressure circuit for permitting fluid pressure to be released from said fluid operated chair assembly for lowering said seat member, and a third selectable fluid pressure circuit for permitting fluid pressure to be directed to said bubble massage assembly.

5. A bathtub chair comprising:

a fluid operated chair assembly, said fluid operated chair assembly including a seat member and a plurality of extensible legs which support said seat member, said extensible legs comprising fluid shock absorbers having air chambers fluidly interconnected by hollow tubing with a common valve in fluid communication with said hollow tubing for selectively controlling a release of air from the air chambers for reducing shocks as the seat member is raised and lowered;

a fluid pressure generating assembly for generating pneumatic air pressure; and, a fluid pressure valve assembly connected between said fluid operated chair assembly and said fluid pressure generating assembly, for controlling fluid pressure applied to said fluid operated chair assembly.

6. The apparatus described in claim 5 and further comprising a plurality of suction cups, each of said suction cups being mounted to a bottom portion of an individual one of said extensible legs for providing a grip between the extensible legs and a floor of a bathtub.

7. The apparatus described in claim 6 and further comprising a rotation assembly which permits rotation of the seat member with respect to said bathtub.

8. The apparatus described in claim 7 wherein said rotation assembly comprises a top rotation member connected to the seat member, a bottom rotation member connected to the extensible legs, the top and bottom rotation members each having a channel, and rotatable elements located between the bottom rotation member and the top rotation member within said channels such that rotation of the top rotation member is permitted with respect to the bottom rotation member.

9. The apparatus described in claim 8 wherein said seat member includes a top flexible portion, a bottom rigid portion, and two peripheral spacer members located between the top flexible portion and the bottom rigid portion.

* * * * *